US010134250B2

(12) United States Patent
Shigezumi et al.

(10) Patent No.: US 10,134,250 B2
(45) Date of Patent: Nov. 20, 2018

(54) SENSOR SYSTEM

(71) Applicant: ROHM CO., LTD., Kyoto (JP)

(72) Inventors: Takeya Shigezumi, Kyoto (JP); Kunihiro Komiya, Kyoto (JP); Kenta Konishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 77 days.

(21) Appl. No.: 15/299,672

(22) Filed: Oct. 21, 2016

(65) Prior Publication Data

US 2017/0116829 A1 Apr. 27, 2017

(30) Foreign Application Priority Data

Oct. 27, 2015 (JP) ..... 2015-211156

(51) Int. Cl.
*G08B 13/08* (2006.01)
*G08B 13/14* (2006.01)
*G08B 25/10* (2006.01)

(52) U.S. Cl.
CPC ..... *G08B 13/08* (2013.01); *G08B 13/14* (2013.01); *G08B 25/10* (2013.01)

(58) Field of Classification Search
CPC ..... G08B 13/08; G08B 13/14; G08B 25/008; G08B 25/10
USPC .... 340/545.1, 500, 505, 528, 539.1, 539.21, 340/541
See application file for complete search history.

(56) References Cited

U.S. PATENT DOCUMENTS 7,113,099 B2 * 9/2006 Tyroler ..... G06K 7/10079 340/539.32
7,538,666 B2 * 5/2009 Campman ..... G07C 9/00111 340/539.13
7,894,942 B2 * 2/2011 Perry ..... H05B 37/0227 700/14
9,606,261 B2 * 3/2017 Shimizu ..... G07C 9/00174
9,772,612 B2 * 9/2017 McCarthy, III ..... G05B 15/02
2007/0132637 A1 * 6/2007 Kolavennu ..... G01C 21/16 342/450
2015/0379860 A1 * 12/2015 Vardi ..... G08B 25/10 340/8.1

(Continued)

FOREIGN PATENT DOCUMENTS

JP 2009-238165 10/2009

*Primary Examiner* — Eric M Blount
(74) *Attorney, Agent, or Firm* — Fish & Richardson P.C.

(57) ABSTRACT

A sensor system includes: a radio transmitting device transmitting a predetermined radio signal regularly; a sensor detecting opening/closing or locking/unlocking of a partition mechanism installed in a door of a building or a site; and an information processing device. The information processing device includes: a radio receiving part receiving the predetermined radio signal and result of detection of the sensor; a decision part deciding whether or not a person exists in the building or the site, based on the radio signal; a determination part determining the decision on existence of the person every trigger timing being a timing defined based on the result of the detection of the sensor; an information generation part generating information related to the behavior of the person based on the decision on existence of the person determined at the trigger timing; and an information output part outputting the information generated by the information generation part.

15 Claims, 7 Drawing Sheets

(56) References Cited

U.S. PATENT DOCUMENTS

2016/0018560 A1* 1/2016 Shimizu ..... G07C 9/00174
73/488
2016/0189529 A1* 6/2016 Lee ..... G08B 25/008
340/541

* cited by examiner

| | |
|---|---|
| Resident X | Unique identification information of sensor tag 1A |
| Resident Y | Unique identification information of sensor tag 1B |

| Storage item | Storage contents |
|---|---|
| Indoor state | At home/not present for each sensor tag |
| Latest state | At home/ not present for each sensor tag |
| Final reception time | Time for each sensor tag |
| Final door closing time | Time |

| Indoor state | latest state | E-mail contents |
|---|---|---|
| All not present | All not present | Intruder warning |
| Resident Y not present | Resident Y at home | Y returning home |
| Resident X at home | Resident X not present | X going out |
| Any state except all not present | No change | (No e-mail transmission) |

SENSOR SYSTEM

CROSS-REFERENCE TO RELATED APPLICATION

This application is based upon and claims the benefit of priority from Japanese Patent Application No. 2015-211156, filed on Oct. 27, 2015, the entire contents of which are incorporated herein by reference.

TECHNICAL FIELD

The present disclosure relates to a sensor system.

BACKGROUND

A variety of sensor systems capable of grasping the behavior of people are proposed in the related art.

For example, there has been proposed a residence monitoring system which is a sensor system which includes a radio slave unit which a resident always carries and a human detection sensor, and grasps the behavior of the residents and nonresidents.

This residence monitoring system decides that a nonresident intrudes into a living room if a level of reception of a signal transmitted from the radio slave unit is lowered or there is a reaction in the human detection sensor. In addition, the residence monitoring system decides that the resident is not carrying the radio slave unit if there is no change in the level of reception of the signal transmitted from the radio slave unit even when there is a reaction in the human detection sensor. In addition, the residence monitoring system decides that an abnormality has occurred if the level of reception of the signal transmitted from the radio slave unit is high and there is no reaction in the human detection sensor.

The above-described residence monitoring system is configured to include a human detection sensor installed in a living room. The installed human detection sensor may impair the aesthetic appearance of the living room. In addition, the installed human detection sensor may give a resident an impression that he/she is being monitored and the resident may feel uneasy about the human detection sensor. In other words, the installed human detection sensor may be unfavorable to the resident.

In addition, the above-described residence monitoring system requires the resident to always carry the radio slave unit even in the living room, which may make the resident feel uncomfortable.

SUMMARY

The present disclosure provides some embodiments of a sensor system which is capable of grasping the behavior of people without the use of a human detection sensor.

According to one embodiment of the present disclosure, there is provided a sensor system including: at least one radio transmitting device configured to transmit a predetermined radio signal regularly; a sensor configured to detect a change in a status of a partition mechanism; and an information processing device. The information processing device includes: a radio receiving part which receives the predetermined radio signal and a result of the detection of the sensor; a decision part which decides whether or not at least one object exists, based on the predetermined radio signal; a determination part which determines the decision on the existence of the at least one object every trigger timing which is a timing defined based on the result of the detection of the sensor; an information generation part which generates information related to a behavior of the at least one object based on the decision on the existence of the at least one object determined at the trigger timing; and an information output part which outputs the information generated by the information generation part.

In some embodiments, the trigger timing may be a timing at which a predetermined time elapses after the status of the partition mechanism is changed.

In some embodiments, the predetermined time may be larger than two times and smaller than three times a transmission period of the predetermined radio signal.

In some embodiments, after a second trigger timing, the information generation part may generate the information related to the behavior of the at least one object based on a result of comparison between the decision on the existence of the at least one object determined at a latest trigger timing and the decision on the existence of the at least one object determined at a trigger timing earlier than the latest trigger timing.

In some embodiments, the decision part may decide the existence of the at least one object based on a reception strength of the predetermined radio signal.

In some embodiments, the decision part may decide the existence of the at least one object based on a lapse time after the radio receiving part receives the predetermined radio signal.

In some embodiments, the predetermined radio signal may contain a unique identification information item of the at least one radio transmitting device, and the information processing device may include a correspondence relationship storage part which stores a correspondence relationship between the at least one object and the unique identification information item.

In some embodiments, the number of the at least one radio transmitting device may be two or more and the number of the at least one object may be two or more.

In some embodiments, the at least one object may include an object corresponding to a plurality of the unique identification information item.

According to another embodiment of the present disclosure, there is provided a sensor system including: a stationary sensor configured to detect take-out and return of an object to be managed; and a generation part configured to generate information related to the take-out and return of the object to be managed, based on a result of the detection of the stationary sensor.

In some embodiments, the number of stationary sensors may be two or more and the number of objects to be managed may be two or more. The generation part may include: a receiving part which receives a result of the detection of the stationary sensor and the unique identification information of the stationary sensor; and a storage part which stores a correspondence relationship between the object to be managed and the unique identification information.

In some embodiments, the object to be managed may be a common object used in common by a plurality of users.

DETAILED DESCRIPTION

First Embodiment

Figure 1:
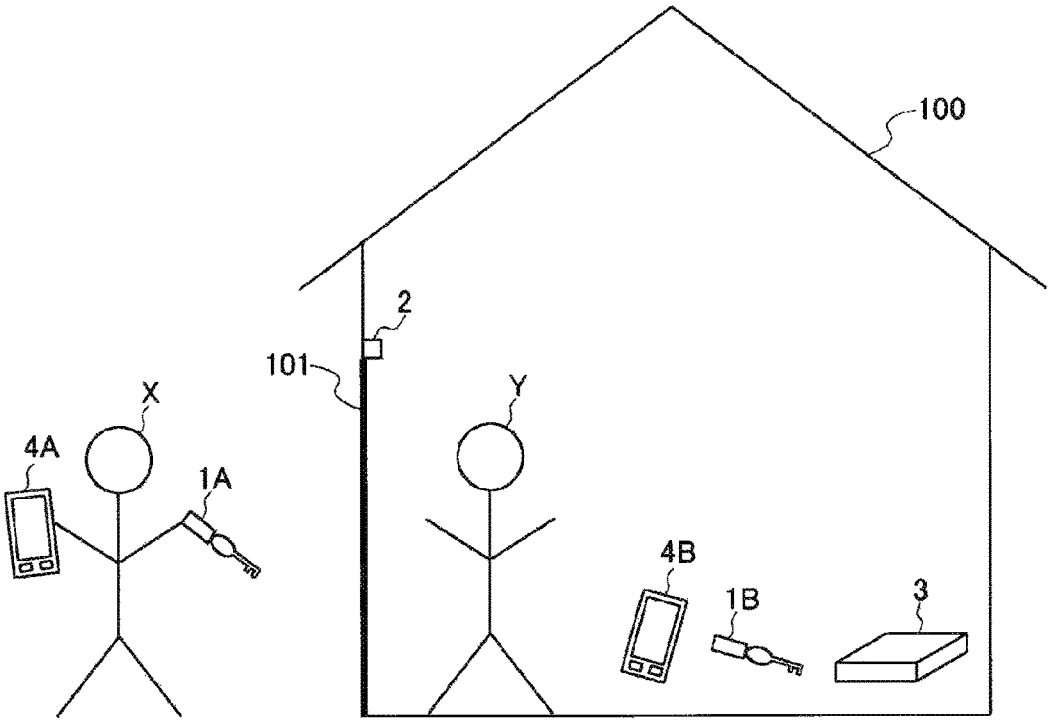
FIG. 1 is a view schematically illustrating the configuration of a sensor system according to a first embodiment of the present disclosure.

The configuration of a sensor system according to a first embodiment will now be described with reference to FIG. 1. FIG. 1 is a view schematically illustrating the configuration of a sensor system according to a first embodiment of the present disclosure. The sensor system according to this embodiment includes radio transmitting devices 1A and 1B for transmitting a predetermined radio signal regularly, an opening/closing detection sensor 2 for detecting the opening/closing of a door 101 installed in a doorway (entrance) of a house 100, and an information processing device 3 for detecting whether or not each of the owners of the radio transmitting devices 1A and 1B is at home, based on the predetermined radio signal transmitted from the radio transmitting devices 1A and 1B. An example of the predetermined radio signal may include a radio signal such as Bluetooth® communication, Zigbee® communication, specific small power radio, or the like.

The radio transmitting devices 1A and 1B are one example of a "radio transmitting device" described in the claim. The opening/closing detection sensor 2 is one example of a "sensor" described in the claim. The information processing device 3 is one example of an "information processing device" described in the claim.

Each of the radio transmitting devices 1A and 1B is a device attached to a thing which is necessarily carried by an owner without special circumstances when the owner is to go out. Although the thing which is necessarily carried by an owner without special circumstances (e.g., carrying forgotten, etc.) when the owner is to go out is illustrated with a key in FIG. 1, the thing may be a wallet, shoes, a bag, clothing, etc. In addition, as described above, since the information processing device 3 detects whether or not an owner of each of the radio transmitting devices 1A and 1B is at home, based on the predetermined radio signal transmitted from the radio transmitting devices 1A and 1B, each of the radio transmitting devices 1A and 1B acts as a sensor for detecting whether or not the owner is at home. If the same function as the radio transmitting device 1A can be realized by a smartphone 4A and the owner of the radio transmitting device 1A necessarily carries the smartphone 4A without special circumstances when going out, the smartphone 4A may be utilized as a substitute for the RF transmitting device 1A.

For this reason, the radio transmitting devices 1A and 1B may be referred to as a sensor tag 1A and a sensor tag 1B, respectively. In the following description, the sensor tag 1A and the sensor tag 1B may be simply referred to as a sensor tag 1 when it is not necessary to distinguish between them. In addition, in the following description, the owner of the sensor tag 1A is assumed as a resident X residing in the house 100 and the owner of the sensor tag 1B is assumed as a resident Y residing in the house 100. The sensor tag 1 may be, e.g., of a label type different from that shown in FIG. 1, i.e., of a type attached to a carried thing such as a wallet, shoes, a bag, clothing, etc. by pasting. When the sensor tag 1 is of a label type, there is an advantage in that the sensor tag 1 can be easily attached to the carried thing.

As one example of the opening/closing detection sensor 2, there may be a magnet sensor used to detect opening/closing of the door 101 by detecting a magnet attached to the door 101 in a state where the door 101 is closed but does not detect the magnet in a state where the door 101 is opened. As another example, there may be a contact sensor used to detect the opening/closing of the door 101 by contact with the door 101 in a state where the door 101 is closed but does not contact with the door 101 in a state where the door 101 is opened.

In addition, unlike this embodiment, a sensor to detect locking/unlocking of the door 101 may be used instead of the opening/closing detection sensor 2. In this case, the present embodiment may be applied by regarding the unlocked state of the door 101 as the opened state of the door 101 in the present embodiment and regarding the locked state of the door 101 as the closed state of the door 101 in the present embodiment.

The information processing device 3 outputs information related to behaviors of the resident X and the resident Y. In the present embodiment, the information processing device 3 outputs the information related to behaviors of the resident X and the resident Y in an e-mail format (the format of the output is not limited thereto), to the smartphone 4A possessed by the resident X and the smartphone 4B possessed by the resident Y via a communication network (not shown).

As one example of the information processing device 3, a general purpose gateway may be used. As another example, a USB (Universal Serial Bus) receiver (a small mobile receiver with a USB port) connected to a USB terminal of the existing personal computer may be used.

Figure 2:
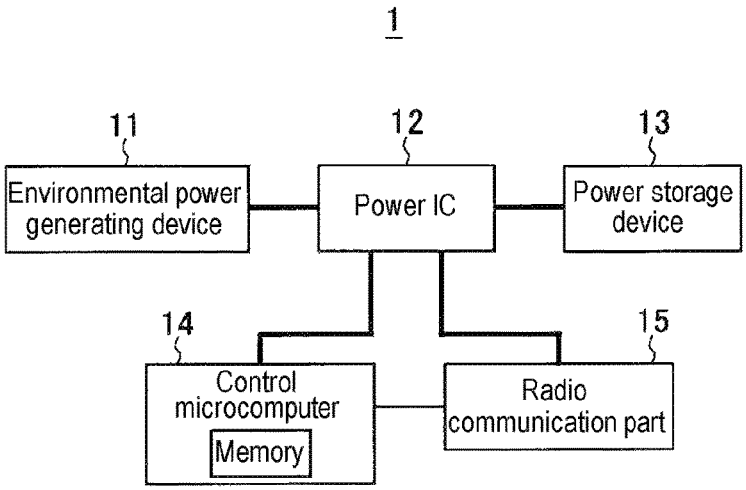
FIG. 2 is a view schematically illustrating the configuration of a radio transmitting device.

Next, the configuration of the sensor tag 1 will be described with reference to FIG. 2. FIG. 2 is a view schematically illustrating the configuration of the sensor tag 1. The sensor tag 1 includes an environmental power generating device 11, a power IC 12, a power storage device 13, a control microcomputer 14 and a radio communication part 15.

The environmental power generating device 11 is a device which collects energy from the surrounding environments and converts the collected energy into power, such as a solar cell for converting solar energy into power, a bimorph structured with two piezoelectric plates bonded to each other for converting a displacement (mechanical energy) caused by an applied force into power, a thermoelectric device for converting heat energy into power, a vibration power generating device for converting vibration energy into power, etc. Although only one environmental power generating device 11 is shown in FIG. 2, two or more environmental power generating devices 11 may be installed. In this case, these environmental power generating devices 11 may be of the same type or of different types. In some embodiments, a solar cell used as the environmental power generating device 11 may be of a flexible shape, such as an organic thin film solar cell or the like.

The power IC 12 stores a surplus of power generated in the environmental power generating device 11 in the power storage device 13. The power storage device 13 may be, e.g., a secondary battery or a condenser. The power IC 12 converts generated power of the environmental power generating device 11 or discharged power of the power storage device 13 into stabilized power of a predetermined voltage and supplies the stabilized power to the control microcomputer 14 and the radio communication part 15. In addition, a primary battery may be used instead of or in addition to the environmental power generating device 11 and the power storage device 13.

The control microcomputer 14 stores unique identification information (e.g., a serial number or the like) of the sensor tag 1 in an internal memory in a nonvolatile manner. The control microcomputer 14 transmits a predetermined radio signal superimposed with the unique identification information of the sensor tag 1 to the radio communication part 15 regularly.

Figures 3, 4, 5:
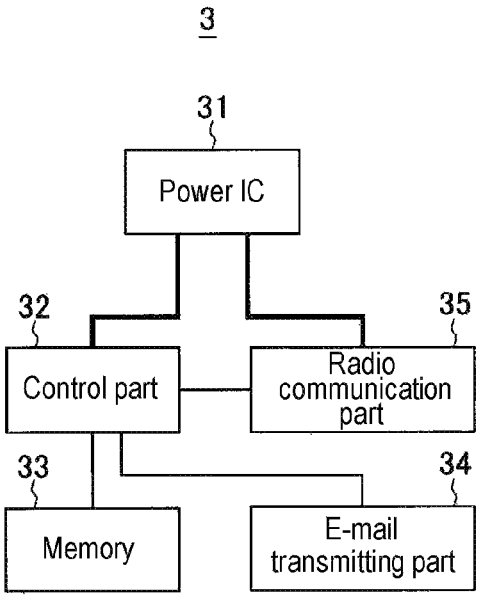
FIG. 3 is a view schematically illustrating the configuration of an information processing device.
FIG. 4 is a table showing a correspondence relationship between a sensor tag owner and sensor tag unique identification information.
FIG. 5 is a table showing some of the data stored in a memory.

Next, the configuration of the information processing device 3 will be described with reference to FIG. 3. FIG. 3 is a view schematically illustrating the configuration of the information processing device 3. The information processing device 3 includes a power IC 31, a control part 32, a memory 33, an e-mail transmitting part 34 and a radio communication part 35. The control part 32, the memory 33 and a portion of the e-mail transmitting part 34 (e.g., a portion except a connector for connecting to a communication network) may be implemented with, e.g., a microcomputer. The radio communication part 35 has the function to receive a predetermined radio signal transmitted from the sensor tag 1 and the function to receive a result of detection of the opening/closing detection sensor 2 wirelessly. Correspondingly, the opening/closing detection sensor 2 includes a radio transmitting part for transmitting the result of detection of the opening/closing detection sensor 2 wirelessly and a power part (e.g., a primary battery and a power converting part for converting output power of the primary battery into stabilized power) for supplying power to the opening/closing detection sensor 2 and the radio transmitting part.

In addition, the opening/closing detection sensor 2 and the information processing device 3 may be connected by a wire and a signal corresponding to the result of detection of the opening/closing detection sensor 2 may be transmitted to the control part 32 via a signal line. In this case, the radio communication part 35 may not have the function to receive the result of detection of the opening/closing detection sensor 2 wirelessly. Here, when using the wired connection of the opening/closing detection sensor 2 with the information processing device 3 to supply DC power from the information processing device 3 to the opening/closing detection sensor 2, transmitting the result of detection of the opening/closing detection sensor 2 in a high frequency signal, and superimposing the DC power on the high frequency signal, the opening/closing detection sensor 2 and the information processing device 3 may be connected by a single signal line. Further, the power part included in the opening/closing detection sensor 2 for supplying power to the opening/closing detection sensor 2 may include the environmental power generating device.

The control part 32 is one example of a "decision part," "determination part" and "information generation part" described in the claims. The memory 33 is one example of a "correspondence relationship storage part" described in the claims. The e-mail transmitting part 34 is one example of an "information output part" described in the claims. The radio communication part 35 is one example of a "radio receiving part" described in the claims.

The power IC 31 converts input power (e.g., commercial AC power) into stabilized power with a predetermined voltage value and supplies the stabilized power to the control part 32 and the radio communication part 35.

The control part 32 generates and outputs information related to behaviors of the resident X and the resident Y according to a program and data stored in the memory 33 in a nonvolatile manner. Specifically, the control part 32 generates the information related to behaviors of the resident X and the resident Y based on a result of reception in the radio communication part 35 and instructs the e-mail transmitting part 34 to output the information related to behaviors of the resident X and the resident Y to the smartphones 4A and 4B.

The memory 33 stores a correspondence relationship between the owner of a sensor tag and the unique identification information of the sensor tag. In this embodiment, as shown in FIG. 4, the resident X and the unique identification information of the sensor tag 1A are associated with each other and the resident Y and the unique identification information of the sensor tag 1B are associated with each other. The information processing device 3 includes an input part (not shown) and may be configured to rewrite the correspondence relationship between the owner of the sensor tag and the unique identification information of the sensor tag, stored in the memory 33, based on data input to the input part.

In addition, unlike this embodiment, when the resident X owns the sensor tag 1A, a sensor tag for wallet and a sensor tag for shoes, unique identification information of these three sensor tags and the resident X may be stored in the memory 33 in association. In this case, this embodiment may be applied by considering the reception strength of the sensor tag 1A to be equal to or lower than a threshold TH if at least one of the reception strengths of the three sensor tags is equal to or lower than the threshold TH and considering the reception strength of the sensor tag 1A to exceed the threshold TH if all of reception strengths of the three sensor tags exceed the threshold TH.

The memory 33 also stores "indoor state," "latest state," "final reception time" and "final door closing time" in a nonvolatile manner, as shown in FIG. 5. In this embodiment, the "indoor state" refers to a state where the resident X is at home or is not present and the resident Y is at home or is absent and the "latest state" also refers to a state where the resident X is at home or is not present and the resident Y is at home or is not present. In addition, in this embodiment, the "final reception time" refers to two cases, i.e., time at which a predetermined radio signal transmitted from the sensor tag 1A is finally received, and a time at which a predetermined radio signal transmitted from the sensor tag 1B is finally received. In addition, in this embodiment, the "final door closing time" refers to a time at which the door 101 is finally closed.

Figure 6:
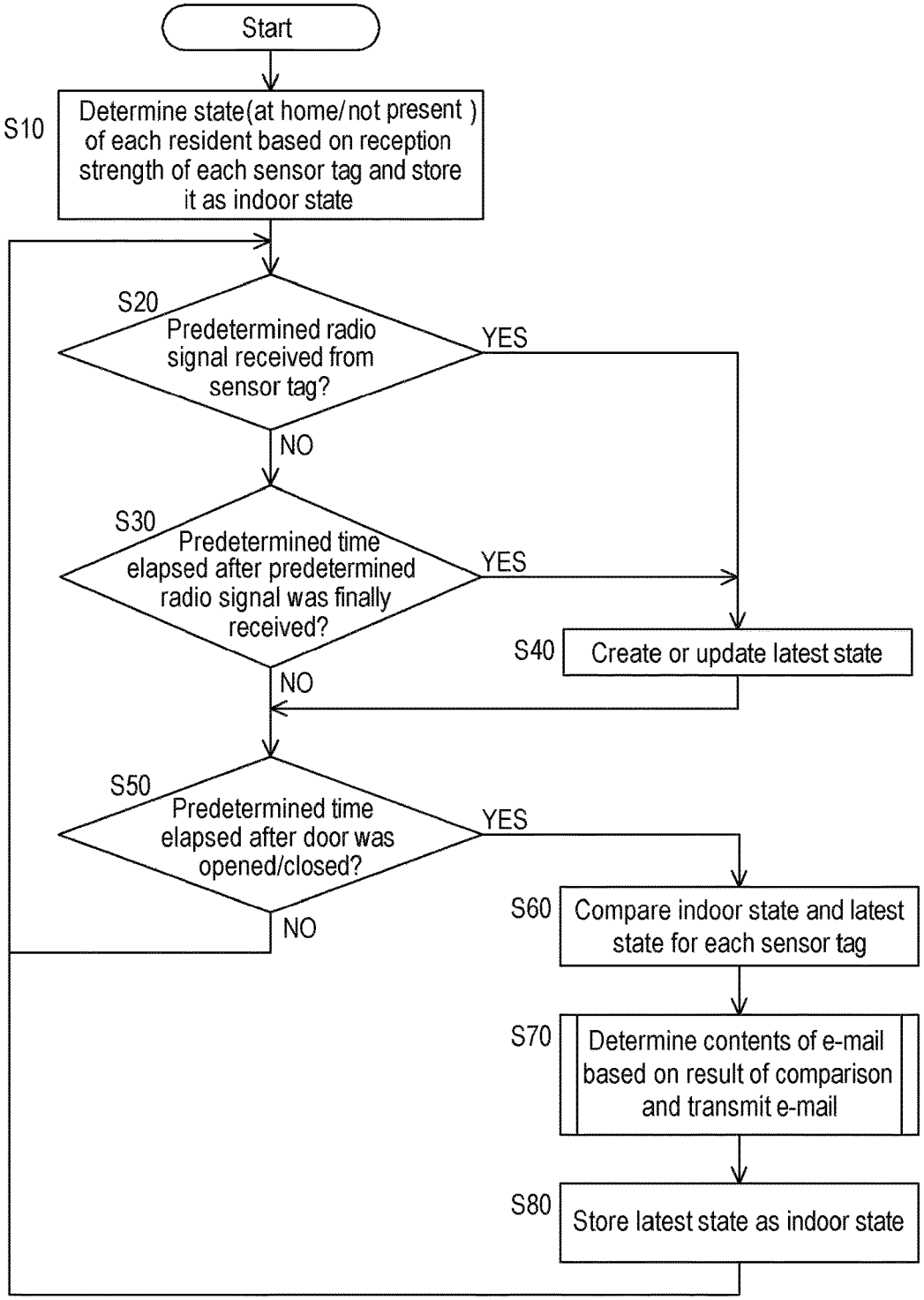
FIG. 6 is a flow chart illustrating the operation of the information processing device.

Next, the operation of the information processing device 3 will be described with reference to FIG. 6. FIG. 6 is a flow chart illustrating the operation of the information processing device 3.

When the starting of the information processing device 3 is completed, the control part 32 determines whether or not each of the residents X and Y is at home, based on the reception strength of a signal received by the radio communication part 35, of the predetermined radio signals from the sensor tags 1A and 1B, and stores a result of the determination, as the indoor state, in the memory 33 (Step S10).

In this embodiment, if the reception strength of the predetermined radio signal from the sensor tag 1A exceeds the threshold TH, it is determined that the resident X is at home. Otherwise (i.e., if the reception strength is equal to or lower than the threshold TH or the radio signal cannot be received), it is determined that the resident X is not present. In addition, if the reception strength of the predetermined radio signal from the sensor tag 1B exceeds the threshold TH, it is determined that the resident Y is at home. Otherwise (i.e., if the reception strength is equal to or lower than the threshold TH or the radio signal cannot be received), it is determined that the resident Y is not present. Therefore, the threshold TH may be set such that the reception strength exceeds the threshold TH when the sensor tag 1 is brought to a place in the house 100 where the sensor tag 1 is likely to be placed and the reception strength is equal to or lower than the threshold TH or the radio signal cannot be received when the sensor tag 1 is brought out of the house 100. Thus, a resident may not always carry the sensor tag 1 in the house 100. Further, in some embodiments, the reception strength may exceed the threshold TH wherever the sensor tag 1 is brought in the house 100. Thus, a restriction on a place in the house 100 where the sensor tag 1 is to be placed is eliminated.

In addition, instead of Step S10, the state of the resident X and Y may be set arbitrarily. Even in this case, the state is corrected to a correct state after a while by a loop of S20 to S50 to be described later. However, in this case, since it is assumed that there is a reception of the predetermined radio signals from the sensor tags 1A and 1B at the point of time when the state of the resident X and Y is set arbitrarily, the process proceeds to Step S20.

At Step S20, the control part 32 determines whether or not at least one of the predetermined radio signals from the sensor tags 1A and 1B has been received by the radio communication part 35. If it is determined that no radio signal is received (NO in Step S20), the process proceeds to Step S30. If it is determined that at least one is received (YES in Step S20), the process proceeds to Step S40.

At Step S30, the control part 32 determines whether or not a predetermined time has elapsed after the predetermined radio signals from the sensor tags 1A and 1B were finally received. If it is determined that a predetermined time has elapsed after at least one was finally received (YES in Step S30), the process proceeds to Step S40. If it is determined that a predetermined time has not elapsed after all were finally received (NO in Step S30), the process proceeds to Step S50.

At Step S40, the control part 32 creates or updates the latest state according to the following process. If the reception strength of the predetermined radio signal from the sensor tag 1A exceeds the threshold TH, it is assumed that the resident X is at home. If the reception strength of the predetermined radio signal from the sensor tag 1A is equal to or lower than the threshold TH, it is assumed that the resident X is not present. If the reception strength of the predetermined radio signal from the sensor tag 1B exceeds the threshold TH, it is assumed that the resident Y is at home. If the reception strength of the predetermined radio signal from the sensor tag 1B is equal to or lower than the threshold TH, it is assumed that the resident Y is not present. If the predetermined time has elapsed after the predetermined radio signal from the sensor tag 1A was finally received, it is assumed that the resident X is not present. If the predetermined time has elapsed after the predetermined radio signal from the sensor tag 1B was finally received, it is assumed that the resident Y is not present.

The predetermined time used in Step S30 may be larger than two times and smaller than three times the transmission period of the predetermined radio signal transmitted from the sensor tag 1. By setting the predetermined time to be larger than two times the transmission period, the process can be prevented from proceeding from Step S30 to Step S40 even though the radio signal is not received accidentally once due to a sudden radio interference or the like, thereby preventing the latest state from being incorrect. In addition, by setting the predetermined time to be smaller than three times (2.5 times in some embodiments) the transmission period, the proceeding of Step S30 to Step S40 can be prevented from being excessively delayed. In addition, the predetermined time used in Step S30 may be the same as or different from a predetermined time used in Step S50 to be described later.

At Step S50, the control part 32 determines whether or not a predetermined time has elapsed after the door 101 was closed (i.e., from the point of time when an opening/closing state of the door 101 is changed from an opened state to a closed state), based on a result of detection of the opening/closing detection sensor 2. If it is determined that a predetermined time has not elapsed, (NO in Step S50), the process returns to Step S20. If it is determined that a predetermined time has elapsed, (YES in Step S50), the process proceeds to Step S60. Timings (TT1 and TT2 in FIGS. 8 to 11) at which the predetermined time has elapsed after the door 101 was closed are one example of "trigger timing" described in the claim.

The predetermined time (PT in FIGS. 8 to 11) used in Step S50 may be larger than two times and smaller than three times the transmission period (P in FIGS. 8 to 11) of the predetermined radio signal transmitted from the sensor tag 1. By setting the predetermined time to be larger than two times the transmission period, after the predetermined radio signal is transmitted twice or more from the sensor tag 1 after the door 101 is closed, the process proceeds to Step S60 in which the latest state is determined. Therefore, it is possible to avoid the latest state from being determined based on a state of being not received accidentally once due to a sudden radio interference or the like after the door 101 is closed and it is possible to prevent the latest state from being incorrect. In addition, by setting the predetermined time to be smaller than three times (2.5 times in some embodiments) the transmission period, Step S60 can be performed without being excessively delayed. In addition, in a case where a state of being not received accidentally once due to a sudden radio interference or the like after the door 101 is closed hardly ever occurs, the predetermined time (PT in FIGS. 8 to 11) used in Step S50 may be set to be equal to the transmission period (P in FIGS. 8 to 11) of the predetermined radio signal transmitted from the sensor tag 1. However, if the threshold TH is set to be high in setting the predetermined time (PT in FIGS. 8 to 11) used in Step S50 to be equal to the transmission period (P in FIGS. 8 to 11) of the predetermined radio signal transmitted from the sensor tag 1, the reception strength of a predetermined radio signal from a sensor tag carried by the resident may exceed the threshold TH when a resident is out of the house 100 but is yet near the house 100 immediately after the door 101 is closed. Therefore, when the threshold TH is set to be high, the predetermined time (PT in FIGS. 8 to 11) used in Step S50 may be set to be slightly longer than the transmission period (P in FIGS. 8 to 11) of the predetermined radio signal transmitted from the sensor tag 1. Thus, since the time at which a resident goes away from the house 100 until the time at which the predetermined time (PT in FIGS. 8 to 11) has elapsed after the door 101 was closed can be sufficiently secured, the latest state determined at the timing at which the predetermined time (PT in FIGS. 8 to 11) has elapsed after the door 101 was closed can be set with a correct content stating that "there is no resident who has a sensor tag and is out of the house 100." The setting of the predetermined time (PT in FIGS. 8 to 11) used in Step S50 to be equal to the transmission period (P in FIGS. 8 to 11) of the predetermined radio signal transmitted from the sensor tag 1 and the setting of the predetermined time (PT in FIGS. 8 to 11) used in Step S50 to be slightly longer than the transmission period (P in FIGS. 8 to 11) of the predetermined radio signal transmitted from the sensor tag 1 may also be applied to a relationship between the predetermined time used in Step S30 and the transmission period of the predetermined radio signal transmitted from the sensor tag 1. In other words, the predetermined time used in Step S30 may be set to be equal to the transmission period of the predetermined radio signal transmitted from the sensor tag 1 and the predetermined time used in Step S30 may be set to be slightly longer the transmission period of the predetermined radio signal transmitted from the sensor tag 1.

At Step S60, the control part 32 compares the indoor state and the latest state for the sensor tag 1A and compares the indoor state and the latest state for the sensor tag 1B.

Thereafter, the control part 32 determines the contents (the information related to behaviors of the resident X and the resident Y) of the e-mail based on a result of the comparison in Step S60 and instructs the e-mail transmitting part 34 to transmit the e-mail (Step S70). Then, after the transmission of the e-mail, the control part 32 stores the latest state, as the indoor state, in the memory 33 (Step S80). Thus, the latest state disappears immediately after the process of Step S80. Then, the process returns to Step S20 after the process of Step S80.

Figures 7, 8:
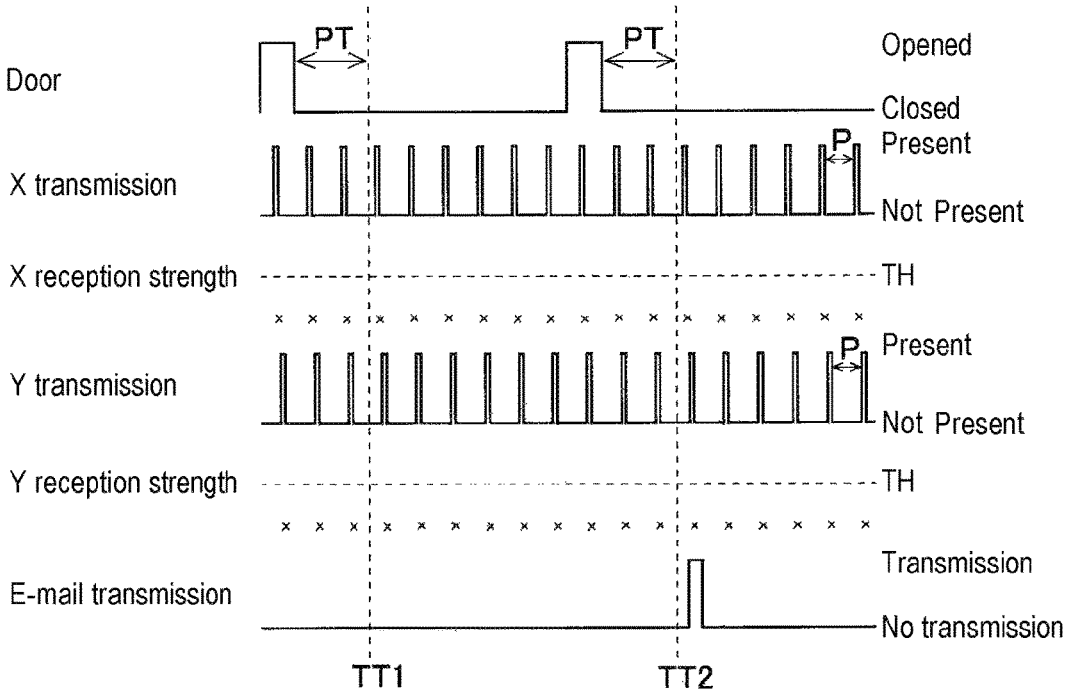
FIG. 7 is a table showing examples of contents of an e-mail.
FIG. 8 is a time chart corresponding to contents (intruder warning) of the e-mail.

FIG. 7 is a table showing examples of the contents of the e-mail determined in Step S70. FIGS. 8 to 11 are time charts corresponding to the contents of the e-mail. In FIGS. 8 to 11, the reception strength when a predetermined radio signal is transmitted by the sensor tag 1 but is not received by the information processing device 3 is x-marked.

FIG. 8 shows a situation where the indoor state determined at the trigger timing TT1 is "both (the residents X and Y) not present" and, thereafter, the latest state determined at the trigger timing TT2 though the door 101 is opened/closed once is also "both (the residents X and Y) not present." In this case, there is a high possibility that a person other than the residents X and Y intrudes into the house 100 when the door 101 is opened/closed immediately before the trigger timing TT2. Therefore, the contents of the e-mail are set to "intruder warning."

Figure 9:
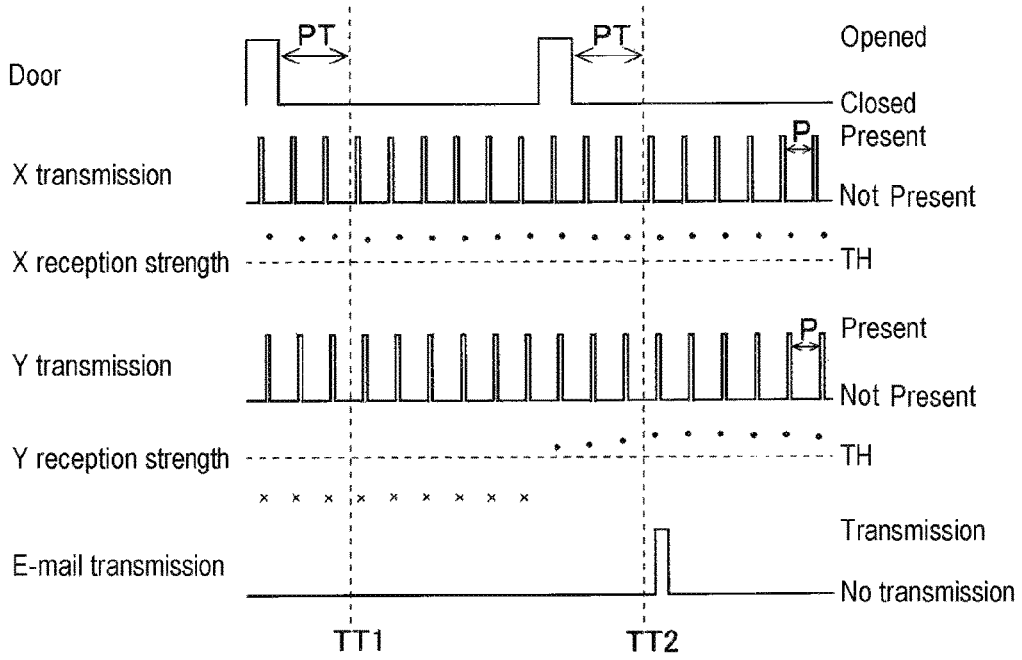
FIG. 9 is a time chart corresponding to contents (Y returning home) of the e-mail.

FIG. 9 shows a situation where the indoor state determined at the trigger timing TT1 is "resident X at home and resident Y not present" and, thereafter, the latest state determined at the trigger timing TT2 when the door 101 is opened/closed once is "resident X at home and resident Y at home." In this case, the resident Y is moving into the house 100 from the outside of the house 100 when the door 101 is opened/closed immediately before the trigger timing TT2. Therefore, the contents of the e-mail are set to "resident Y returning home." In addition, in this case, since the resident Y understands his own behavior, the transmission destination of the e-mail may be set to be only the smartphone 4A rather than both the smartphones 4A and 4B. In other words, according to the contents (the information related to behaviors of the residents X and B) of the e-mail, the transmission destination of the corresponding information may be changed. In addition, a modification may be considered where no e-mail is transmitted based on the idea that home returning of the resident Y can be easily grasped since the resident X is at home.

Figure 10:
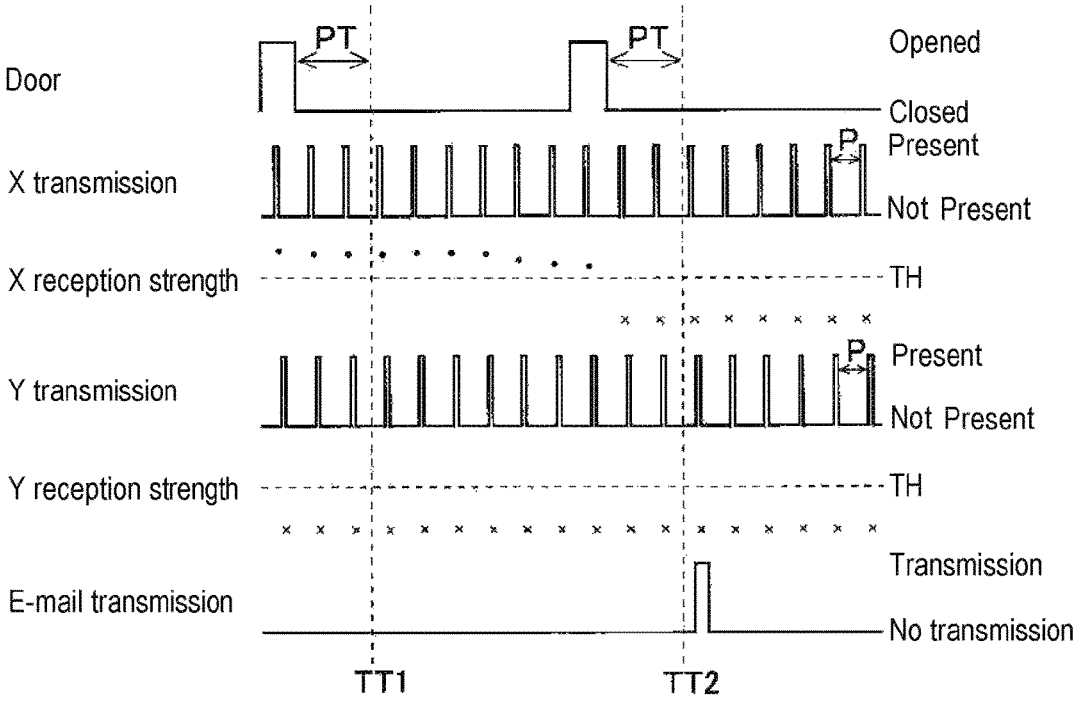
FIG. 10 is a time chart corresponding to contents (X going out) of the e-mail.

FIG. 10 shows a situation where the indoor state determined at the trigger timing TT1 is "resident X at home and resident Y not present" and, thereafter, the latest state determined at the trigger timing TT2 when the door 101 is opened/closed once is "resident X not present and resident Y not present." In this case, the resident X is moving to the outside of the house 100 from the inside of the house 100 when the door 101 is opened/closed immediately before the trigger timing TT2. Therefore, the contents of the e-mail are set to "resident X going out." In addition, in this case, since the resident X understands his own behavior, the transmission destination of the e-mail may be set to be only the smartphone 4B rather than both the smartphones 4A and 4B.

Figure 11:
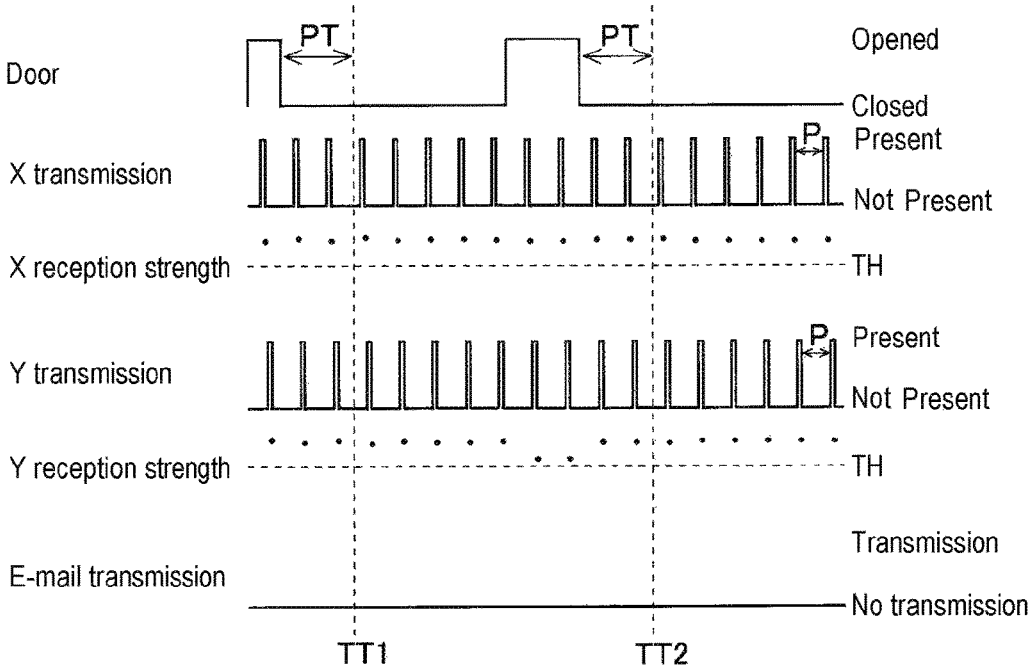
FIG. 11 is a time chart corresponding to contents (no e-mail transmission) of the e-mail.

FIG. 11 shows a situation where the indoor state determined at the trigger timing TT1 is "resident X at home and resident Y at home" and, thereafter, the latest state determined at the trigger timing TT2 when the door 101 is opened/closed once is "resident X at home and resident Y at home." In this case, it may be assumed that the resident Y makes a visitor correspondence around the door 101 in the house 100 in a period of an opened state of the door 101 that occurred immediately before the trigger timing TT2. Information related to behaviors of the residents in such a case where at least one of the residents is at home and the residents do not go in/out is not transmitted to the smartphones 4A and 4B.

As described above, the sensor system according to the present embodiment determines whether the residents X and Y are at home or not present, based on the predetermined radio signal transmitted from the sensor tag 1, and the determination is made every trigger timings TT1 and TT2 determined according to a result of detection of the opening/closing detection sensor 2. Therefore, it is possible to grasp human behaviors without any human detection sensor.

In addition, in the present embodiment, the indoor state and the latest state are compared in Step S60, and the contents (information related to behaviors of the residents X and Y) of the e-mail are determined based on a result of the comparison. However, the contents (information related to behaviors of the residents X and Y) of the e-mail may be determined based on only the latest state. However, in this modification, for example in a case where the resident X is at home in the latest state, it may be unclear whether the resident X returned home when the door 101 was opened/closed immediately before the trigger timing TT2 or whether the resident X returned home when the door 101 was opened/closed previously and the resident X was already at home when the door 101 was opened/closed immediately before the trigger timing TT2.

Second Embodiment

Figure 12:
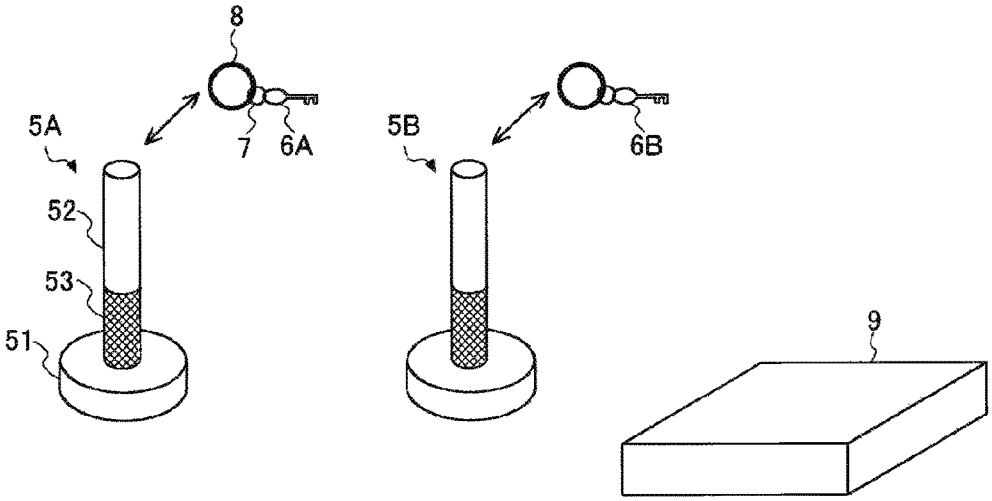
FIG. 12 is a view schematically illustrating the configuration of a sensor system according to a second embodiment of the present disclosure.

FIG. 12 is a view schematically illustrating the configuration of a sensor system according to a second embodiment of the present disclosure. The sensor system according to the second embodiment includes return stands 5A and 5B, each of which contains a key detection sensor 58 (see FIG. 13 to be described later), and an information processing device 9 which generates information related to take-out and return of keys 7A and 7B based on a result of detection of the key detection sensor 58. The return stands 5A and 5B are placed for use in a predetermined place.

The key detection sensor 58 is one example of a "stationary sensor" described in the claims, and the information processing device 9 is one example of "generation part" described in the claims.

The return stand 5A is provided to return a warehouse key 6A, and the return stand 5B is provided to return a company car key 6B. The warehouse key 6A and the company car key 6B are common objects used in common by a plurality of users. In the following description, the return stands 5A and 5B are simply referred to as a return stand 5 when it is not necessary to distinguish between them. In addition, in the following description, the warehouse key 6A and the company car key 6B are simply referred to as a key 6 when it is not necessary to distinguish between them.

The return stand 5 includes a disc-like base 51 and a pole 52 extending vertically from the center of the base 51. A solar cell 53 is installed in the lower side (toward the base 51) of the pole 52. In a case where the solar cell 53 has a curved shape along the periphery of the pole 52 as in this embodiment, an organic thin film solar cell or the like may be used. In addition, for example, in a case where a solar cell installation portion of the pole 52 has a planar shape unlike this embodiment, a flat solar cell may be used.

The key detection sensor 58 (see FIG. 13 to be described later) is contained in the base 51. In this embodiment, a magnet sensor for detecting the proximity of a magnet is used as the key detection sensor 58. A magnet ring 8 is connected to the key 6 via a key ring 7. An inner diameter of the magnet ring 8 is determined such that the pole 52 passes through the magnet ring 8. When the key 6 is returned, the magnet ring 8 contacts the base 51 and the key detection sensor 58 detects the proximity of the magnet. In other words, the key detection sensor 58 does not detect the proximity of the magnet when the key 6 is taken out, and the key detection sensor 58 detects the proximity of the magnet when the key 6 is returned. In addition, unlike this embodiment, for example, instead of the magnet sensor, a contact sensor may be used as the key detection sensor 58.

A label or the like indicating that the return stand 5A is a warehouse key return stand (e.g., a label described with a "warehouse key") may be attached to the base 51 of the return stand 5A. Similarly, a label or the like indicating that the return stand 5B is a company car key return stand (e.g., a label described with a "company car key") may be attached to the base 51 of the return stand 5B. Instead of or in addition to the attachment of the label, the return stand 5A and the return stand 5B may differ from each other in shape in order to know which return stand corresponds to which key.

Figure 13:
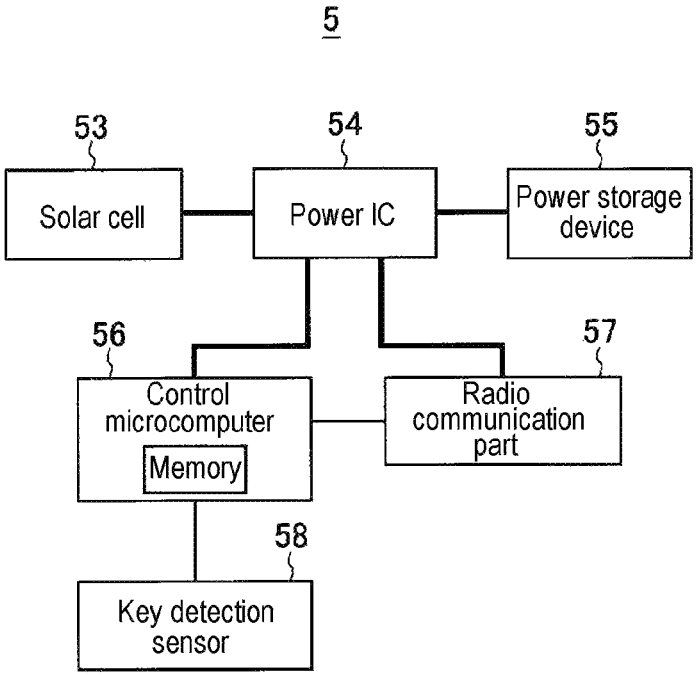
FIG. 13 is a view schematically illustrating the configuration of a return stand.

FIG. 13 is a view schematically illustrating the configuration of the return stand 5. The return stand 5 includes a solar cell 53, a power IC 54, a power storage device 55, a control microcomputer 56, a radio communication part 57 and a key detection sensor 58.

The power IC 54 stores a surplus of power generated in the solar cell 53 in the power storage device 55. The power storage device 55 may be, e.g., a secondary battery, a condenser or the like. The power IC 54 converts generated power of the solar cell 53 or discharged power of the power storage device 55 into a stabilized power of a predetermined voltage and supplies the stabilized power to the control microcomputer 56 and the radio communication part 57. In addition, a primary battery may be used instead of or in addition to the solar cell 53 and the power storage device 55.

The control microcomputer 56 stores unique identification information (e.g., a serial number or the like) of the return stand 5 in an internal memory in a nonvolatile manner. In addition, the control microcomputer 56 supplies power to the key detection sensor 58 and receives a result of detection of the key detection sensor 58. The control microcomputer 56 transmits to the radio communication part 57 a predetermined radio signal superimposed with the result of detection of the key detection sensor 58 and the unique identification information of the return stand 5, with a change in the result of detection of the key detection sensor 58 (a change from proximity detection to proximity non-detection of a magnet or a change from proximity non-detection to proximity detection of the magnet) as a trigger. An example of the predetermined radio signal may include a radio signal such as Bluetooth® communication, Zigbee® communication, specific small power radio, or the like.

Figure 14:
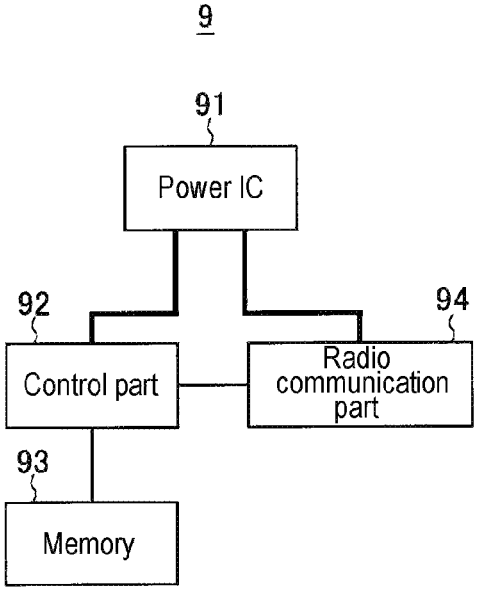
FIG. 14 is a view schematically illustrating the configuration of an information processing device.

FIG. 14 is a view schematically illustrating the configuration of the information processing device 9. The information processing device 9 includes a power IC 91, a control part 92, a memory 93 and a radio communication part 94. The control part 92 and the memory 93 may be implemented with, e.g., a microcomputer. The radio communication part 94 has the function to receive a predetermined radio signal transmitted from the sensor tag 1. The memory 93 is one example of a "storage part" described in the claims. The radio communication part 94 is one example of a "receiving part" described in the claims.

The power IC 91 converts input power (e.g., commercial AC power) into stabilized power of a predetermined voltage value and supplies the stabilized power to the control part 92 and the radio communication part 94.

The control part 92 generates information related to take-out and return of the key 6 based on a result of detection of the key detection sensor 58, according to a program and data stored in the memory 93 in a nonvolatile manner. Specifically, the control part 92 generates the information related to take-out and return of the keys 6A and 6B based on a result of reception in the radio communication part 94. In addition, the control part 92 may transmit the generated information to an external server, a mobile device or the like.

The memory 93 stores a correspondence relationship between the type of the key 6 and the unique identification information of the return stand 5. The information processing device 9 includes an input part (not shown), and may be configured to rewrite the correspondence relationship between the type of the key 6 and the unique identification information of the return stand 5, stored in the memory 93, based on data input to the input part.

As described above, the sensor system according to the present embodiment generates the information related to take-out and return of the key 6 based on a result of detection of the key detection sensor 58. Therefore, it is possible to grasp human behaviors (operation of take-out and return of the key 6) without any human detection sensor.

Other Modifications

In addition to the above embodiments, the present disclosure can be modified in various ways without departing from the spirit and scope of the disclosure.

For example, as a modification of the first embodiment, instead of the door 101 of the house 100, a door of a warehouse, an entry/exit door of a room of an office building or a door of a school may be used.

As another modification of the first embodiment, the information processing device 3 and other devices may be used in combination. For example, the information processing device 3 and an emergency button may be used in combination. In this case, when the emergency button is pushed, the information processing device 3 may transmit an e-mail reporting a state of emergency to all residents. As another example, the information processing device 3 and lighting equipment may be used in combination. In this case, the information processing device 3 may automatically turn off the lighting equipment when all residents are not present and may automatically turn on the lighting equipment when at least one of the residents returns home. As another example, when the information processing device 3 and the lighting equipment are used in combination, the information processing device 3 may transmit an intruder warning by e-mail while intimidating an intruder by blinking the lighting equipment.

As another modification of the first embodiment, the number of sensor tags 1 may be one. In this case, information related to behavior of one resident is generated and output. In addition, in this case, for example, if a user of the sensor system has grasped a person who carries the sensor tag 1 at the time of going out, the unique identification information of the sensor tag 1 may not be superimposed on a predetermined radio signal.

As another modification of the first embodiment, when the latest state is updated in Step S40, it may be determined that a problem such as power shortage or the like has occurred in the sensor tag 1A in a case where the state of the resident X is changed from "at home" to "not present" though the opening/closing of the door 101 is not detected by the opening/closing detection sensor 2 after the last trigger timing, and a result of the determination may be reflected on the contents of an e-mail. Similarly, when the latest state is updated in Step S40, it may be determined that a problem such as power shortage or the like has occurred in the sensor tag 1 in a case where the state of the resident Y is changed from "at home" to "not present" though the opening/closing of the door 101 is not detected by the opening/closing detection sensor 2 after the last trigger timing, and a result of the determination may be reflected on the contents of an e-mail. In addition, in a case where a result of detection of the opening/closing detection sensor 2 cannot be acquired in Step S50, it may be determined that a problem such as power shortage or the like has occurred in the opening/closing detection sensor 2, and a result of the determination may be reflected on the contents of an e-mail.

As a modification of the second embodiment, the information processing device 9 and other devices may be used in combination. For example, the information processing device 9 and a take-out reservation database system may be used in combination. In this case, the information processing device 9 may detect an unreserved take-out and transmit an instruction signal to the return stand 5 in which the unreserved take-out is made such that a warning is reported from the return stand 5 in which the unreserved take-out is made.

As another modification of the second embodiment, the number of key detection sensors 58 may be one. In this case, the unique identification information of the return stand 5 may not be superimposed on a predetermined radio signal.

As another modification of the second embodiment, the return stand 5 and the information processing device 9 may be connected by a wire, and a signal corresponding to the result of detection of the key detection sensor 58 may be transmitted to the control part 92 via a signal line. In this case, the radio communication parts 57 and 94 may be replaced with an interface for wired connection. Here, when using the wired connection of the return stand 5 and the information processing device 9 to supply DC power from the information processing device 9 to the return stand 5, transmitting the result of detection of the key detection sensor 58 in a high frequency signal, and superimposing the DC power on the high frequency signal, the return stand 5 and the information processing device 9 may be connected by a single signal line.

INDUSTRIAL APPLICABILITY

The present disclosure can be utilized as, e.g., a sensor system for detecting "at home" and a sensor system for detecting the removal of a common object.

According to the present disclosure in some embodiments, it is possible to provide a sensor system which is capable of grasping behaviors of persons without any human detection sensor.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A sensor system comprising:

at least one radio transmitting device configured to transmit a predetermined radio signal regularly;

a sensor configured to detect a change in a status of a partition mechanism; and an information processing device, wherein the information processing device includes:

a radio receiving part which receives the predetermined radio signal and a result of the detection of the sensor;

a decision part which decides whether or not at least one object exists, based on the predetermined radio signal;

a determination part which determines the decision on the existence of the at least one object every trigger timing which is a timing defined based on the result of the detection of the sensor;

an information generation part which generates information related to a behavior of the at least one object based on the decision on the existence of the at least one object determined at the trigger timing; and an information output part which outputs the information generated by the information generation part, and wherein the trigger timing is a timing at which a predetermined time elapses after the status of the partition mechanism is changed.

2. The sensor system of claim 1, wherein the predetermined time is larger than two times and smaller than three times a transmission period of the predetermined radio signal.

3. A sensor system comprising:

at least one radio transmitting device configured to transmit a predetermined radio signal regularly;

a sensor configured to detect a change in a status of a partition mechanism; and an information processing device, wherein the information processing device includes:

a radio receiving part which receives the predetermined radio signal and a result of the detection of the sensor;

a decision part which decides whether or not at least one object exists, based on the predetermined radio signal;

a determination part which determines the decision on the existence of the at least one object every trigger timing which is a timing defined based on the result of the detection of the sensor;

an information generation part which generates information related to a behavior of the at least one object based on the decision on the existence of the at least one object determined at the trigger timing; and an information output part which outputs the information generated by the information generation part, and wherein, after a second trigger timing, the information generation part generates the information related to the behavior of the at least one object based on a result of comparison between the decision on the existence of the at least one object determined at a latest trigger timing and the decision on the existence of the at least one object determined at a trigger timing earlier than the latest trigger timing.

4. The sensor system of claim 1, wherein the decision part decides the existence of the at least one object based on a reception strength of the predetermined radio signal.

5. The sensor system of claim 1, wherein the decision part decides the existence of the at least one object based on a lapse time after the radio receiving part receives the predetermined radio signal finally.

6. The sensor system of claim 1, wherein the predetermined radio signal contains a unique identification information item of the at least one radio transmitting device, and wherein the information processing device includes a correspondence relationship storage part which stores a correspondence relationship between the at least one object and the unique identification information item.

7. The sensor system of claim 6, wherein the number of the at least one radio transmitting device is two or more and the number of the at least one object is two or more.

8. The sensor system of claim 7, wherein the at least one object includes an object corresponding to a plurality of unique identification information items.

9. The sensor system of claim 1, wherein the partition mechanism is installed in a door of a building or a site, and wherein the at least one object is a person.

10. The sensor system of claim 9, wherein the trigger timing is a timing at which the predetermined time elapses after the partition mechanism is closed or locked.

11. The sensor system of claim 10, wherein the predetermined time is larger than two times and smaller than three times a transmission period of the predetermined radio signal.

12. A sensor system comprising:

at least one radio transmitting device configured to transmit a predetermined radio signal regularly;

a sensor configured to detect a change in a status of a partition mechanism; and an information processing device, wherein the information processing device includes:

a radio receiving part which receives the predetermined radio signal and a result of the detection of the sensor;

a decision part which decides whether or not at least one object exists, based on the predetermined radio signal;

a determination part which determines the decision on the existence of the at least one object every trigger timing which is a timing defined based on the result of the detection of the sensor;

an information generation part which generates information related to a behavior of the at least one object based on the decision on the existence of the at least one object determined at the trigger timing; and an information output part which outputs the information generated by the information generation part, wherein the partition mechanism is installed in a door of a building or a site, wherein the at least one object is a person, and wherein, after a second trigger timing, the information generation part generates the information related to the behavior of the person based on a result of comparison between the decision on the existence of the person determined at a latest trigger timing and the decision on the existence of the person determined at a trigger timing earlier than the latest trigger timing.

13. The sensor system of claim 9, wherein the decision part decides the existence of the person based on a reception strength of the predetermined radio signal.

14. The sensor system of claim 9, wherein the decision part decides the existence of the person based on a lapse time after the radio receiving part receives the predetermined radio signal finally.

15. The sensor system of claim 9, wherein the predetermined radio signal contains a unique identification information item of the at least one radio transmitting device, and wherein the information processing device includes a correspondence relationship storage part which stores a correspondence relationship between the person and the unique identification information item.

* * * * *